US011965653B2

(12) United States Patent
Chiranthan et al.

(10) Patent No.: US 11,965,653 B2
(45) Date of Patent: Apr. 23, 2024

(54) DILUTION AIR INLETS WITH NOTCHED TIP AND SLOTTED TAIL FOR COMBUSTOR

(71) Applicant: General Electric Company, Schenectady, NY (US)

(72) Inventors: Ranganatha Narasimha Chiranthan, Karnataka (IN); Rimple Rangrej, Karnataka (IN); Saket Singh, Karnataka (IN); Pradeep Naik, Karnataka (IN); Gregory A. Boardman, Owens Cross Roads, AL (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/355,689

(22) Filed: Jun. 23, 2021

(65) Prior Publication Data

US 2022/0412560 A1 Dec. 29, 2022

(51) Int. Cl.
*F23R 3/06* (2006.01)

(52) U.S. Cl.
CPC ..... *F23R 3/06* (2013.01); *F23R 2900/03045* (2013.01)

(58) Field of Classification Search
CPC .... F23R 3/06; F23R 3/002; F23R 3/04; F23R 3/10; F23R 3/16; F23R 2900/03041; F23R 2900/03042; F23R 2900/03043; F23R 2900/03044; F23R 2900/03045
See application file for complete search history.

(56) References Cited

U.S. PATENT DOCUMENTS

| | | | | |
|---|---|---|---|---|
| 7,415,827 | B2 | 8/2008 | Bertolotti et al. | |
| 7,854,122 | B2 | 12/2010 | Steele | |
| 7,891,194 | B2 | 2/2011 | Biebel et al. | |
| 8,161,752 | B2 | 4/2012 | Yankowich et al. | |
| 8,387,397 | B2 | 3/2013 | Chen et al. | |
| 8,572,983 | B2 | 11/2013 | Xu | |
| 9,010,121 | B2 | 4/2015 | Taylor et al. | |
| 9,957,811 | B2 | 5/2018 | Hucker et al. | |
| 2009/0003998 | A1 | 1/2009 | Woodcock et al. | |
| 2010/0115967 | A1* | 5/2010 | Maltson | F01D 5/188 415/115 |
| 2011/0123312 | A1* | 5/2011 | Venkataramanan | F01D 5/186 415/115 |

(Continued)

FOREIGN PATENT DOCUMENTS

| | | | | |
|---|---|---|---|---|
| CN | 101016997 A | | 8/2007 | |
| GB | 858525 A | * | 8/1958 | F23R 3/06 |

*Primary Examiner* — Thomas P Burke
(74) *Attorney, Agent, or Firm* — Venable LLP; Edward A. Kmett; Michele V. Frank

(57) ABSTRACT

A combustor for a gas turbine engine has a combustor liner that has a cold surface side and a hot surface side, the liner defining an upstream end and a downstream end, and a dilution opening through the combustor liner. The dilution opening includes a main dilution hole portion having an upstream edge and a downstream edge, a notched portion disposed at the upstream edge and extending upstream from the upstream edge, the notched portion being in fluid communication with the main dilution hole portion, and a slotted portion disposed at the downstream edge and extending downstream of the downstream edge, the slotted portion being in fluid communication with the main dilution hole portion.

14 Claims, 7 Drawing Sheets

(56) References Cited

U.S. PATENT DOCUMENTS

| | | | | |
|---|---|---|---|---|
| 2015/0267542 | A1* | 9/2015 | Holzhaeuser | F01D 25/12 416/95 |
| 2016/0123592 | A1 | 5/2016 | Drake et al. | |
| 2016/0186998 | A1 | 6/2016 | Kostka, Jr. et al. | |
| 2016/0327272 | A1* | 11/2016 | Sandoval | F23R 3/50 |
| 2017/0343217 | A1 | 11/2017 | Chen et al. | |
| 2018/0010465 | A1 | 1/2018 | Xu | |
| 2019/0085767 | A1* | 3/2019 | Vise | F23R 3/002 |
| 2020/0277868 | A1 | 9/2020 | Hucker et al. | |

* cited by examiner

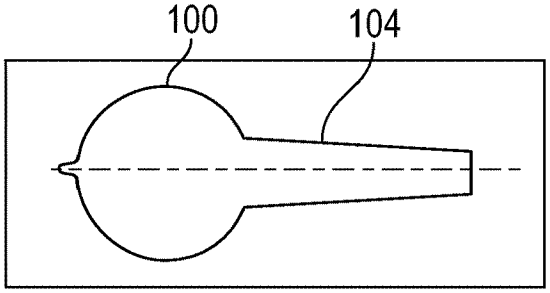
FIG. 10
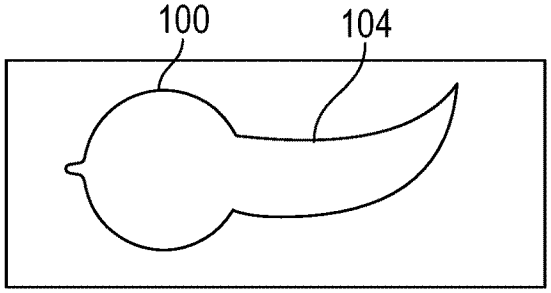
FIG. 11
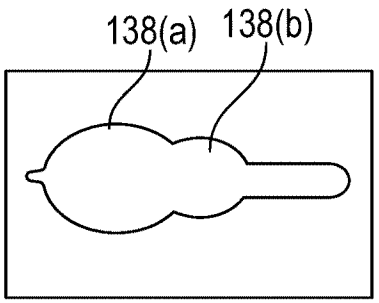
FIG. 12
FIG. 13
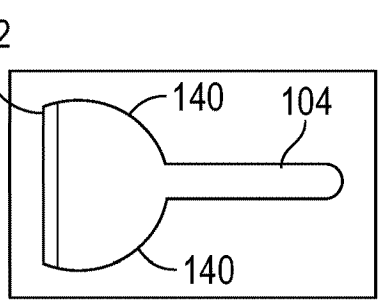
FIG. 14
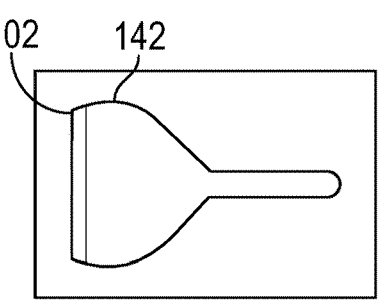
FIG. 15

DILUTION AIR INLETS WITH NOTCHED TIP AND SLOTTED TAIL FOR COMBUSTOR

TECHNICAL FIELD

The present disclosure relates to a dilution of combustion gases in a combustion chamber of a gas turbine engine.

BACKGROUND

In conventional gas turbine engines, it has been known to provide a flow of dilution air into a combustion chamber downstream of a primary combustion zone.

Conventionally, an annular combustor may include both inner and outer liners forming a combustion chamber between them. The inner and outer combustion liners may include dilution holes through the liners that provide a flow of air (i.e., a dilution jet) from a passage surrounding the annular combustor into the combustion chamber. Some applications have been known to use circular holes for providing dilution air flow to the combustion chamber. The flow of air through the circular dilution holes in the conventional combustor mixes with combustion gases within the combustion chamber to provide quenching of the combustion gases from a primary zone. High temperature regions seen behind the dilution jet (i.e., in the wake region of dilution jet) are associated with high NOx formation. In addition, the circular dilution air jet does not spread laterally, thereby creating high temperatures in-between dilution jets that also contribute to high NOx formation.

BRIEF SUMMARY

In one aspect, the present disclosure relates to a combustor for a gas turbine engine, where the combustor includes a combustor liner having a cold surface side and a hot surface side, the combustor liner defining an upstream end and a downstream end and defining a combustion chamber on the hot surface side. The combustor further includes a bypass oxidizer flow passage on the cold surface side of the combustor liner, the bypass oxidizer flow passage being defined between the cold surface side of the combustor liner and an outer casing of the combustor, the bypass oxidizer flow passage supplying a flow of oxidizer therethrough from the upstream end of the combustor liner to the downstream end of the combustor liner. The combustor additionally includes a dilution opening through the combustor liner. The dilution opening includes: a main dilution hole portion having an upstream edge and a downstream edge, a notched portion disposed at the upstream edge and extending upstream from the upstream edge, the notched portion being in fluid communication with the main dilution hole portion, and a slotted portion disposed at the downstream edge and extending downstream of the downstream edge, the slotted portion being in fluid communication with the main dilution hole portion.

According to another aspect, the present disclosure relates to a combustor liner for a combustor of a gas turbine engine. The combustor liner includes: a liner having a cold surface side and a hot surface side, the liner defining an upstream end and a downstream end, and a dilution opening through the combustor liner. The dilution opening includes: a main dilution hole portion having an upstream edge and a downstream edge, a notched portion disposed at the upstream edge and extending upstream from the upstream edge, the notched portion being in fluid communication with the main dilution hole portion, and a slotted portion disposed at the downstream edge and extending downstream of the downstream edge, the slotted portion being in fluid communication with the main dilution hole portion.

Additional features, advantages, and embodiments of the present disclosure are set forth or apparent from consideration of the following detailed description, drawings and claims. Moreover, it is to be understood that both the foregoing summary and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

FIG. 10 depicts another arrangement of a dilution opening slotted portion, according to an embodiment of the present disclosure.

FIG. 11 depicts another arrangement of a dilution opening slotted portion, according to an embodiment of the present disclosure.

FIG. 12 depicts another arrangement of a dilution opening slotted portion, according to an embodiment of the present disclosure.

FIG. 13 depicts another arrangement of a dilution opening slotted portion, according to an embodiment of the present disclosure.

FIG. 14 depicts another arrangement of a dilution opening slotted portion, according to an embodiment of the present disclosure.

FIG. 15 depicts another arrangement of a dilution opening slotted portion, according to an embodiment of the present disclosure.

DETAILED DESCRIPTION

Figure 1:
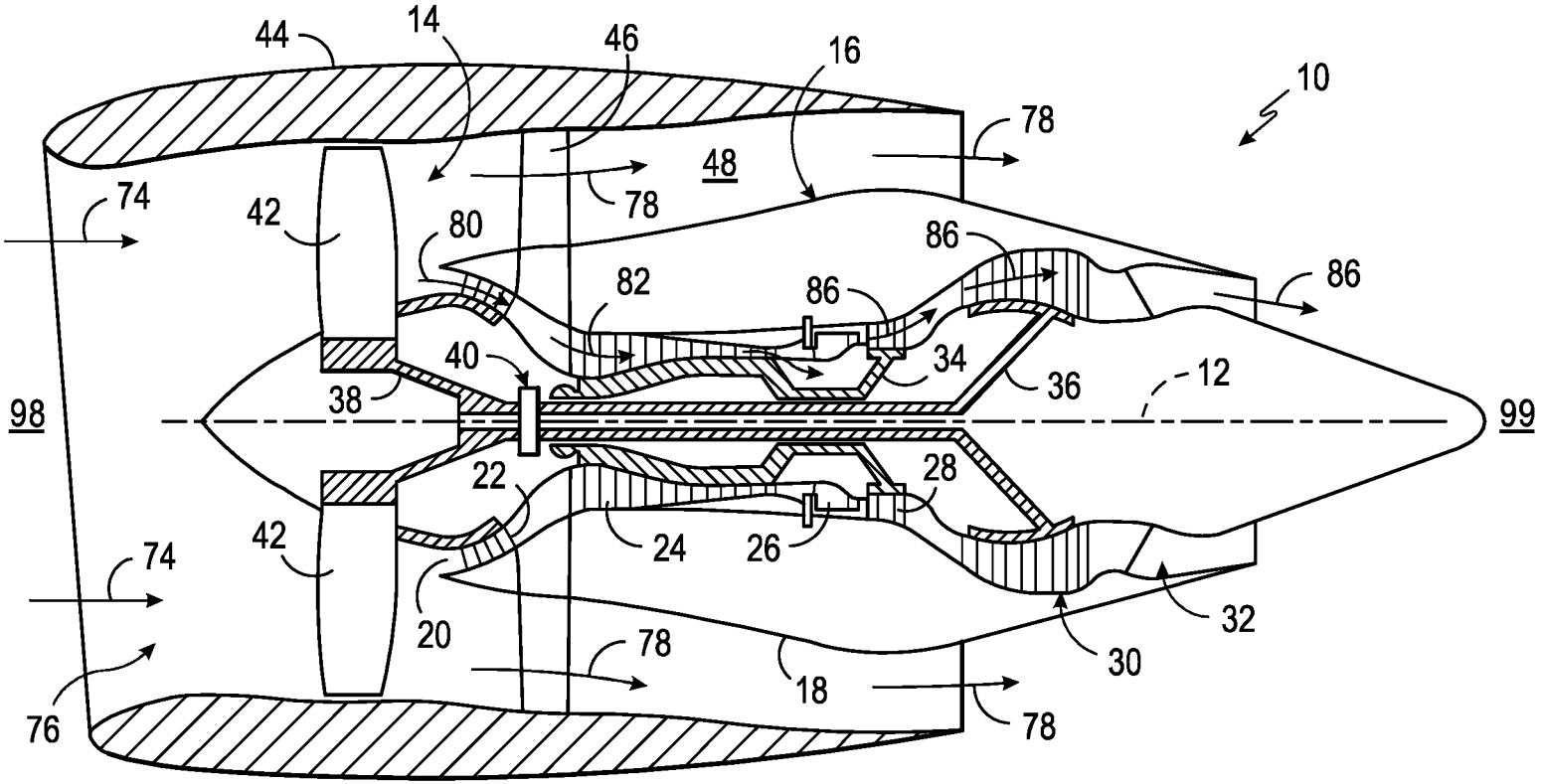
FIG. 1 is a schematic partially cross-sectional side view of an exemplary high by-pass turbofan jet engine, according to an embodiment of the present disclosure.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a combustion section of a turbine engine, air flows through an outer passage surrounding a combustor liner. The air generally flows from an upstream end of the combustor liner to a downstream end of the combustor liner. Some of the air flow in the outer passage is diverted through dilution holes in the combustor liner and into the combustion chamber as dilution air. One purpose of the dilution air flow is to cool (i.e., quench) combustion gases within the combustion chamber before the gases enter a turbine section. However, quenching of the product of combustion from the primary zone must be done quickly and efficiently so that regions of high temperature can be minimized, and thereby NOx emissions from the combustion system can be reduced.

It has generally been known to utilize circular dilution holes through the liner that essentially form a cylindrical flow passage through the liner. Some of the cooling air in the outer passage that flows from the upstream end to the downstream end flows across the cylindrical hole opening in the liner and is diverted through the cylindrical hole. At the leading edge of the cylindrical hole, separation of the air flow occurs such that very little of the dilution air adheres to the forward surface of the hole. The separation can also cause hot gas ingestion into the dilution flow passage, thereby reducing the life of the liner. At the trailing edge of the cylindrical hole along the inner surface of the liner (i.e., inside the combustion chamber), a wake forms in the air flow behind the dilution hole. The wake results in a higher temperature behind the dilution jet, which causes high NOx formation, and is also responsible for reducing the life of the combustor liner.

The present disclosure provides a way to reduce the flow separation within the dilution hole to avoid hot gas ingestion into the dilution flowpath, thereby improving the life of the combustor liner. This disclosure also has features of dilution that provide a better spread and mixing of the dilution air with products of combustion gases. This disclosure further provides a way to reduce the wake at the trailing edge of the dilution hole so as to reduce the temperature in the wake region. According to one aspect, a dilution opening through a combustor liner includes a main dilution hole portion, such as a circular dilution hole, having an upstream edge and a downstream edge, and a notched portion disposed at the upstream edge. The notched portion is in fluid communication with the main dilution hole portion and may be a V-shaped notch with an apex extending in the upstream direction, where the notch may be slanted at an angle so as to extend at least partially through the liner. The notched portion provides for reducing the separation of the air flow that otherwise occurs with the cylindrical hole, thereby avoiding any hot gas ingestion into the dilution flowpath.

The dilution opening of the present disclosure further includes a slotted portion disposed at the downstream edge and extending aft of the downstream edge. The slotted portion extends through the liner and is in fluid communication with the main dilution hole portion. The slotted portion reduces the wake that otherwise occurs at the trailing edge of the hole along the inner surface of the liner and spreads the dilution air passing through the slotted portion downstream. This reduces the higher temperature region in the wake and provides for better durability of the liner around the dilution hole. Additionally, reducing the high temperature behind the dilution jet by reducing or eliminating wakes reduces NOx emission. The slotted portion of the opening behind the forward dilution hole creates a smaller jet behind the dilution that impinges on the forward dilution jet and creates forward dilution jet flow to spread in the lateral direction, thereby improving quenching with the primary zone combustion gases. This further reduces NOx due to the temperature reduction caused by the lateral spread of the dilution air.

Referring now to the drawings, FIG. 1 is a schematic partially cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
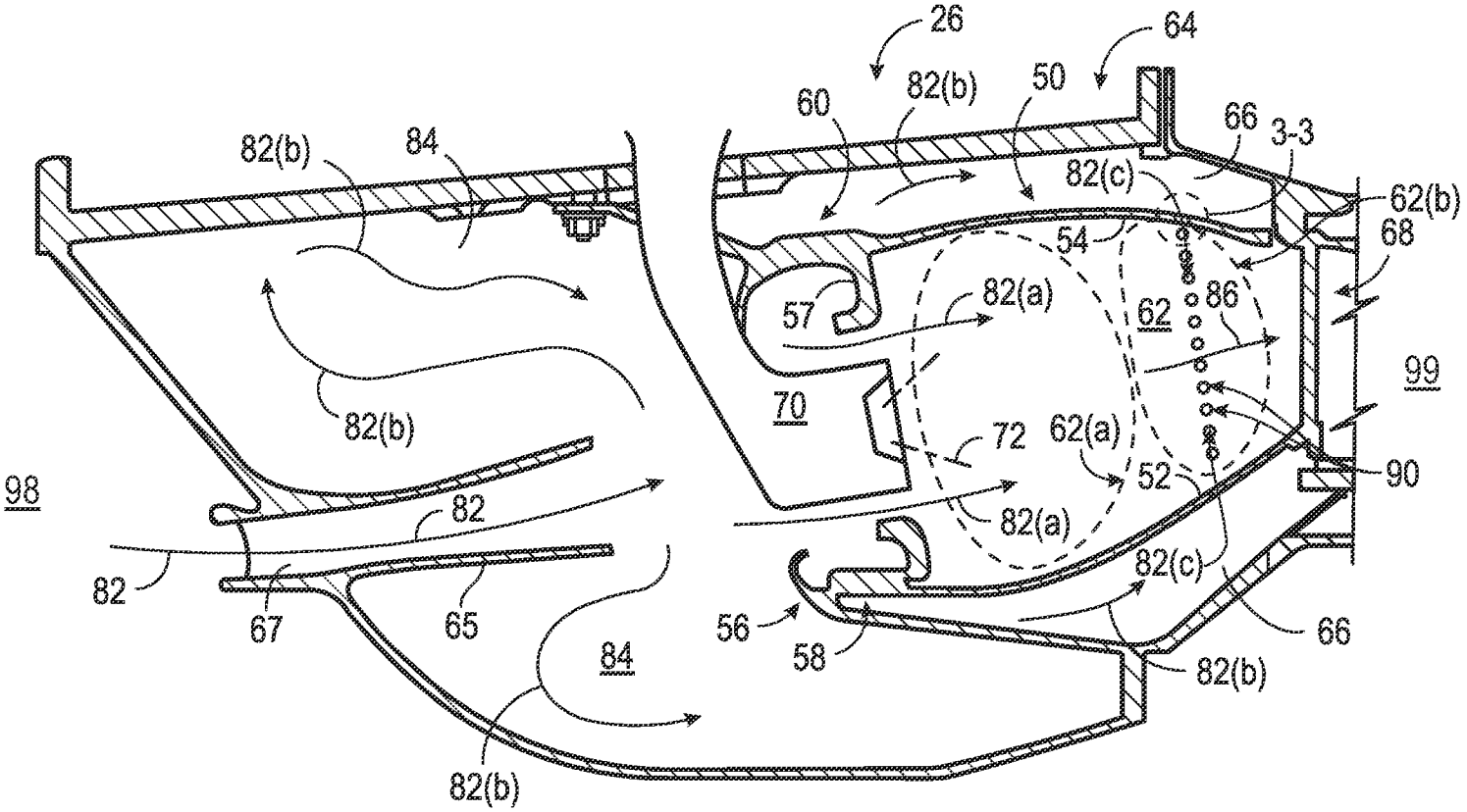
FIG. 2 is a cross-sectional side view of an exemplary combustion section, according to an embodiment of the present disclosure.

FIG. 2 is a cross-sectional side view of an exemplary combustion section 26 of the core engine 16 as shown in FIG. 1. As shown in FIG. 2, the combustion section 26 may generally include an annular type combustor assembly 50 having an inner liner 52, an outer liner 54, a bulkhead wall 56, and a dome assembly 57, together defining a combustion chamber 62. A surface of the liners 52/54 adjacent to the combustion chamber 62 may be referred to as a hot surface side of the liner. The combustion chamber 62 may more specifically define a region defining a primary combustion zone 62(*a*) at which initial chemical reaction of a fuel-oxidizer mixture 72 and/or recirculation of combustion gases 86 may occur before flowing further downstream to dilution zone 62(*b*), where mixture and/or recirculation of combustion products and air may occur before flowing to the HP and LP turbines 28, 30. The bulkhead wall 56 and dome assembly 57 each extends radially between upstream ends 58, 60 of the radially spaced inner liner 52 and the outer liner 54, respectively. The dome assembly 57 is disposed downstream of the bulkhead wall 56, adjacent to the generally combustion chamber 62 defined between the dome assembly 57, the inner liner 52, and the outer liner 54. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within an outer casing 64. An outer and inner flow passage 66 may be defined around the inner liner 52 and/or the outer liner 54. The outer/inner flow passage 66 may also be referred to herein as a bypass oxidizer flow passage. A surface of the inner liner 52 and outer liner 54 adjacent to the outer/inner flow passage 66 may be referred to as a cold surface side of the liner. The inner liner 52 and the outer liner 54 may extend from the bulkhead wall 56 towards a turbine nozzle or inlet 68 to the HP turbine 28 (FIG. 1), thus at least partially defining a hot gas path between the combustor assembly 50 and the HP turbine 28.

As further seen in FIG. 2, each of inner liner 52 and the outer liner 54 of the combustor assembly 50 may include a plurality of dilution openings 90. As will be described in more detail below, dilution opening 90 provides a flow of compressed air 82(*c*) therethrough and into the combustion chamber 62. The flow of compressed air 82(*c*) can thus be utilized to provide quenching of the combustion gases 86 downstream of the primary combustion zone 62(*a*) so as to cool the flow of combustion gases 86 entering the turbine section.

During operation of the engine 10, as shown in FIGS. 1 and 2 collectively, a volume of air as indicated schematically by arrows 74 enters the engine 10 from upstream end 98 through an associated inlet 76 of the nacelle 44 and/or fan assembly 14. As the air 74 passes across the fan blades 42, a portion of the air as indicated schematically by arrows 78 is directed or routed into the bypass airflow passage 48, while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air, as indicated schematically by arrows 82, flows across a compressor exit guide vane (CEGV) 67 and through a pre-diffuser 65 into a diffuser cavity 84 of the combustion section 26.

The compressed air 82 pressurizes the diffuser cavity 84. A first portion of the compressed air 82, as indicated schematically by arrows 82(*a*), flows from the diffuser cavity 84 into the combustion chamber 62 where it is mixed the fuel-oxidizer mixture 72 ejected from fuel nozzle 70 and burned, thus generating combustion gases, as indicated schematically by arrows 86, within a primary combustion zone 62(*a*) of the combustor assembly 50. Typically, the LP and HP compressors 22, 24 provide more compressed air to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer/inner flow passage 66 to provide cooling to the inner liner 52 and outer liner 54. A portion of the compressed air 82(*b*) may be routed through dilution opening 90 (schematically shown as air 82(*c*)) and into the dilution zone 62(*b*) of combustion chamber 62 to provide cooling of the combustion gases 86 in dilution zone 62(*b*), and may also provide turbulence to the flow of combustion gases 86 so as to provide better mixing of the dilution oxidizer gas (compressed air 82(*c*)) with the combustion gases 86. In addition, or in the alternative, at least a portion of compressed air 82(*b*) may be routed out of the diffuser cavity 84. For example, a portion of compressed air 82(*b*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive at downstream end 99.

Figure 3:
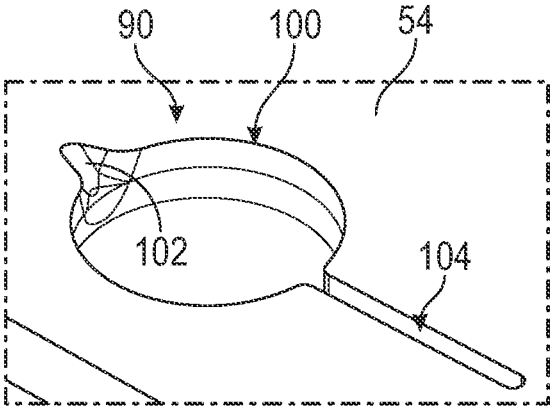
FIG. 3 depicts a perspective view of an exemplary dilution hole according to an embodiment of the present disclosure.

FIG. 3 is a perspective view from a cold surface side of the combustor liner showing an exemplary dilution opening according to an embodiment of the present disclosure. The exemplary dilution opening in FIG. 3 is shown in conjunction with outer liner 54, but it can be understood that the dilution opening may also be included in conjunction with inner liner 52. In addition, while one dilution opening 90 is depicted in FIG. 3 and will be described below, it can be understood that multiple dilution openings 90 may be arranged about the circumference of the combustor liner (see FIG. 2, for example). As seen in FIG. 3, an exemplary dilution opening 90 includes a main dilution hole portion 100, a notched portion 102, and a slotted portion 104, each of which will be discussed in more detail below.

Figure 4:
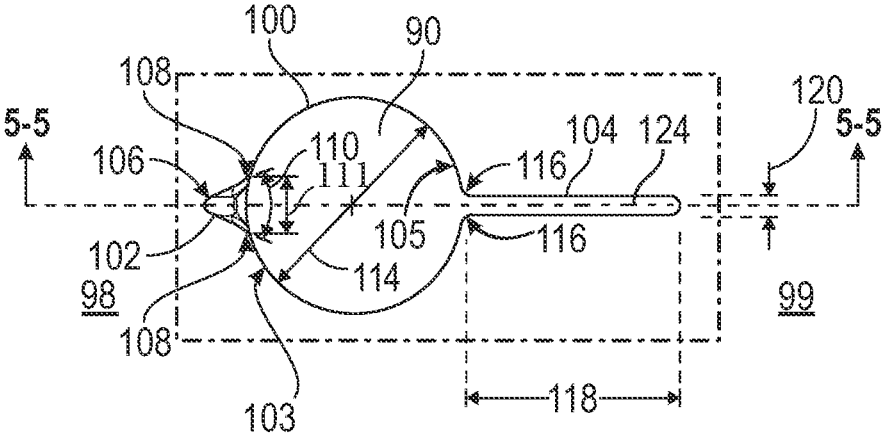
FIG. 4 depicts a plan view of an exemplary dilution hole according to an embodiment of the present disclosure.

Referring now to FIG. 4, depicted therein is a plan view from the cold surface side 54(*a*) (see FIG. 5) of the outer liner 54. As seen in FIG. 4, the dilution opening 90 is arranged along centerline axis 124 extending from the upstream end 98 to the downstream end 99. Centerline axis 124 generally relates to an axial flow direction of the compressed air 82(*b*) within the outer/inner flow passage 66 from the upstream end 98 of the combustion chamber 62 to the downstream end 99 of the combustion chamber 62. Thus, the dilution airflow on the cold surface side 54(*a*) of the liner is generally along the centerline axis 124 from left to right with reference to FIG. 4.

As shown in FIG. 4, main dilution hole portion 100 is shown as being circular, or as seen in FIG. 3, may be a cylindrical hole through the outer liner 54. As will be described later, main dilution hole portion 100 is not limited to being circular or cylindrical, but may be formed of other shapes instead. The circular main dilution hole portion 100 is seen to have a diameter 114, which may be sized based on particular dilution parameters to be achieved.

The slotted portion 104 can be seen to be disposed at the downstream edge 105 (i.e., the edge toward the downstream end 99) of the main dilution hole portion 100, and extends downstream of the main dilution hole portion 100. The slotted portion 104 provides an additional flow of air through the liner downstream of the main dilution hole portion 100. Due to the airflow through the slotted portion 104, at the downstream edge 105 of the main dilution hole portion 100 along the hot side surface of the liner, the wake is reduced, thereby reducing the temperature of the hot gases at the downstream edge. The air flow through the slotted portion 104 also provides a spread of the dilution air laterally in-between main dilution hole portion 100 to provide better quenching of the production of combustion from the primary zone. Reduction in wakes from the slotted portion helps to achieve a lower temperature behind the dilution jet, which improves the life of the liner and also reduces NOx emission.

The slotted portion 104 may be sized based on the diameter 114 of the main dilution hole portion 100. For example, a length 118 of the slotted portion 104 may be sized to be from 10% to 200% of the diameter 114. Of course, other lengths could be implemented instead, and the present disclosure is not limited to the foregoing range. A width 120 of the slotted portion 104 may be sized to be from 5% to 40% of the diameter 114. Of course, other widths could be implemented instead, and the present disclosure is not limited to the foregoing range. Additionally, as will be described below, while the slotted portion 104 is shown as being generally rectangular in shape, other shapes for the slotted portion 104 could be implemented instead, and the present disclosure is not limited to the rectangular shaped slotted portion. Further, while the slotted portion 104 is depicted as being generally parallel to a flow direction along centerline axis 124, the slotted portion 104 may be arranged at an angle (e.g., an acute angle) with respect to the centerline axis 124.

Fillets 116 are disposed at an intersection of the slotted portion 104 and the circular main dilution hole portion 100. Fillets 116 may also be sized based on the diameter 114 and may range from, for example, 2.5% to 20% of the diameter 114. Of course, the present disclosure is not limited to the foregoing range and other fillet sizes may be implemented instead.

Figure 5:
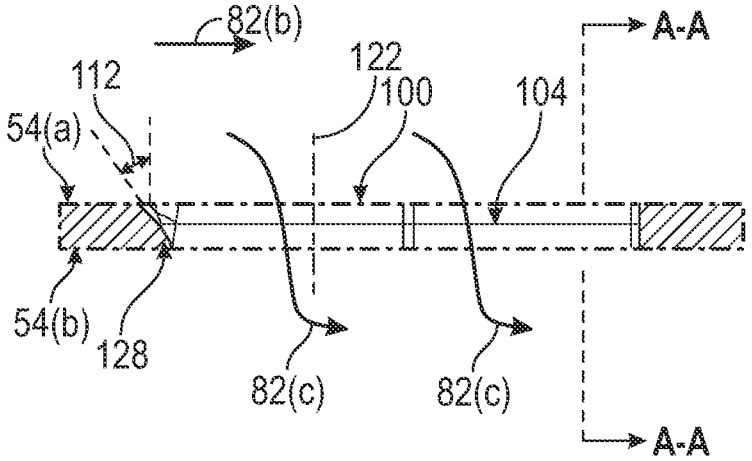
FIG. 5 is a partial cross-sectional view of an exemplary dilution hole according to an embodiment of the present disclosure.
Figure 6A:
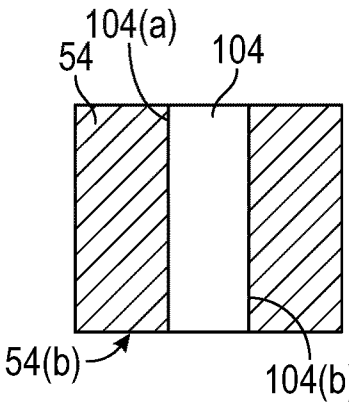
FIG. 6A depicts a partial cross-sectional view of a dilution opening slotted portion, according to an embodiment of the present disclosure.
Figure 6B:
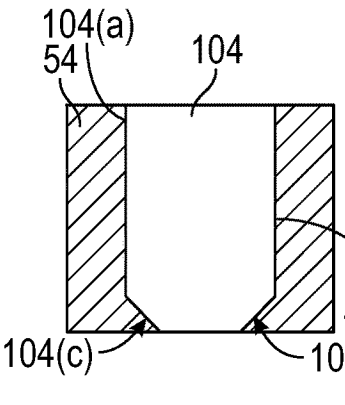
FIG. 6B depicts a partial cross-sectional view of a dilution opening slotted portion, according to an embodiment of the present disclosure.
Figure 6C:
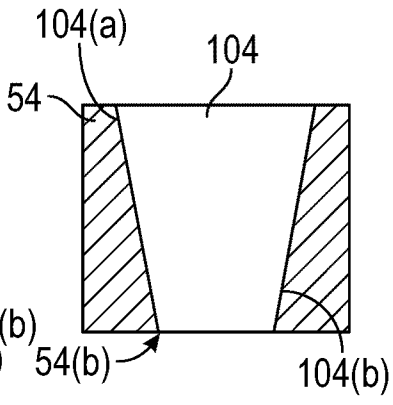
FIG. 6C depicts a partial cross-sectional view of a dilution opening slotted portion, according to an embodiment of the present disclosure.
Figure 6D:
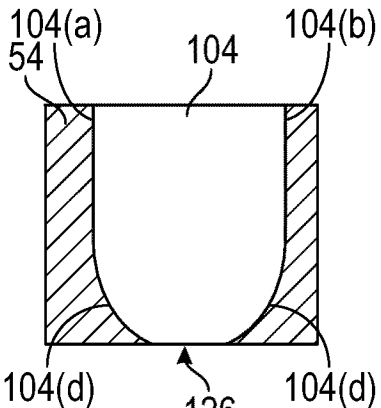
FIG. 6D depicts a partial cross-sectional view of a dilution opening slotted portion, according to an embodiment of the present disclosure.

Referring to FIG. 5, slotted portion 104 is shown as extending through the outer liner 54 from the cold surface side 54(*a*) to the hot surface side 54(*b*). Referring to FIGS. 6A to 6D, depicted therein are partial cross-sectional views taken along plane A-A in FIG. 5. In FIG. 6A, sidewalls 104(*a*), 104(*b*) forming the slotted portion 104 may be straight such that the slotted portion is generally rectangular shaped. However, the slotted portion 104 is not limited to having a rectangular cross section and other shapes may be implemented instead. For example, as seen in FIG. 6C, the sidewalls 104(*a*), 104(*b*) of the slotted portion 104 may form a trapezoidal shaped slot with the sidewalls converging from the cold surface side 54(*a*) to the hot surface side 54(*b*). In yet another aspect as shown in FIG. 6B, the slotted portion 104 may include a generally rectangular shape, but may be chamfered with a chamfer 104(*c*) at the hot surface side 54(*b*) to form a smaller outlet of the slotted portion 104 at the hot surface side 54(*b*) as comparted to a larger inlet at the cold surface side 54(*a*). In yet another aspect depicted in FIG. 6D, the slotted portion 104 may be similar to that of FIG. 6B, but instead of the chamfers 104(*c*), fillets 104(*d*) may be implemented at the hot surface side 54(*b*) such that a smaller exit opening 126 into the combustion chamber 62 is provided for, and a smoother flow of the air at the fillets 104(*d*) can be achieved. Thus, each of the embodiments depicted in FIGS. 6B to 6D may provide for a slotted portion that converges toward the hot surface side 54(*b*) of the outer liner 54.

Figure 18:
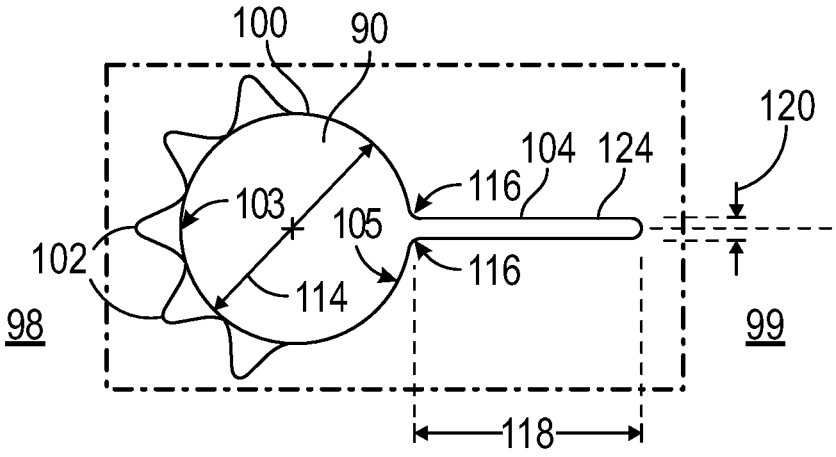
FIG. 18 depicts a plan view of another exemplary dilution hole according to an embodiment of the present disclosure.

Referring back to FIGS. 3 to 5, dilution opening 90 is seen to also include notched portion 102. Notched portion 102 can be seen to be disposed on the upstream edge 103 (i.e., on the upstream end 98) of the main dilution hole portion 100 and extends upstream of the main dilution hole portion 100. The notched portion 102 provides for a smoother transition of the air flow into the main dilution hole portion 100 than the abrupt break in flow over the sharper cylindrical edge in the conventional dilution hole. As a result, the air flow separation that otherwise occurs in the conventional dilution hole is reduced since the air flow adheres better to the gradual transition provided by the notched portion. While FIGS. 3 to 5 depict a single notched portion disposed on the upstream edge 103 of the main dilution hole opening, more than one notched portion 102 may be disposed about the upstream 103 as seen it, for example, FIG. 18.

In FIG. 4, in one embodiment, the notched portion 102 can be seen to be a generally triangular or V-shaped notch, with an apex 106 thereof extending toward the upstream end 98 of the outer liner 54. The apex 106 is shown aligned along the centerline axis 124. Of course, the notched portion 102 is not limited to being triangular or V-shaped and other shapes may be provided instead, such as a circular shape. As shown in FIG. 4, the apex 106 of the triangular (V-shaped) notched portion 102 may be rounded so as to form a fillet at the tip. The apex fillet may aid in providing a smoother airflow across the cold surface side 54(*a*) of the liner into the main dilution hole portion 100.

Triangular-shaped (or V-shaped) notched portion 102 is seen to include a spread angle 110 symmetrical about centerline axis 124. In some embodiments, the spread angle 110 may range from fifteen to one-hundred-eighty degrees. Such a one-hundred-eighty degree embodiment will be discussed in more detail below. Of course, the spread angle 110 is not limited to the foregoing range and other angles may be implemented instead. The spread angle 110 of the notched portion 102 helps to provide a better lateral spread of the dilution air 82(*c*) through the main dilution hole portion 100, which results in better mixedness with the combustion gases 86 in the combustion chamber 62. The better lateral spread of the dilution air 82(*c*) helps to reduce the temperature of the combustion gases 86 as compared with the conventional dilution hole. A base of the V-shaped notched portion 102 intersects the upstream edge 103 of the main dilution hole portion 100 at the fillets 108, and a width 111 of the base of the V-shaped notched portion 102 is less than the diameter 114 of the main dilution hole portion 100. The width 11 of the base of the V-shaped notched portion 102 is arranged generally symmetrical with respect to the centerline axis in a lateral direction orthogonal to the centerline axis 124.

Referring to FIG. 5, notched portion 102 is seen to be disposed at a slant angle 112. The slant angle 112, which may be an acute angle, is shown with respect to centerline axis 122 of the main dilution hole portion 100. The slant angle 112, in some embodiments, may range from five to sixty degrees (i.e., may be an acute angle). Of course, the slant angle is not limited to the foregoing range and other angles may be implemented instead. The slant angle 112 may extend through the combustor liner from the cold surface side 54(*a*) to the hot surface side 54(*b*). Alternatively, and as shown in FIG. 5, the slant angle 112 may extend partially through the liner to intersect the inner surface of the main dilution hole portion 100. A fillet 128 may be formed at the intersection of the slant angle 112 and the inner surface of the main dilution hole portion 100.

Referring back to FIG. 4, an intersection of the notched portion 102 and the circular main dilution hole portion 100 can be seen to include fillets 108. The fillets 108 may range from, for example, 2.5% to 200% of the diameter 114 of the main dilution hole portion 100. Of course, the fillets 108 are not limited to the foregoing range and other sizes may be implemented instead.

Figure 7:
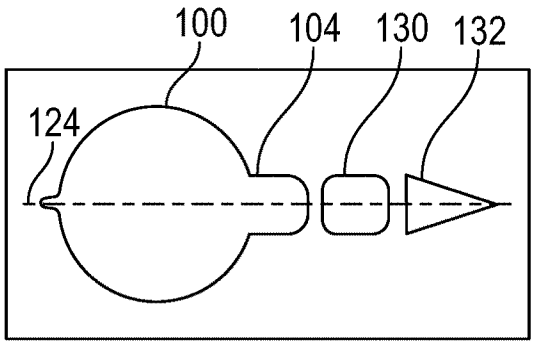
FIG. 7 depicts another arrangement of a dilution opening slotted portion, according to an embodiment of the present disclosure.
Figure 8:
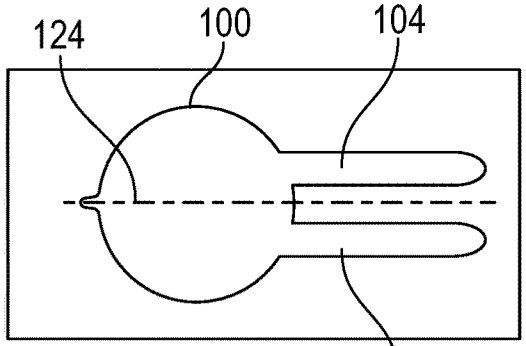
FIG. 8 depicts another arrangement of a dilution opening slotted portion, according to an embodiment of the present disclosure.
Figure 9:
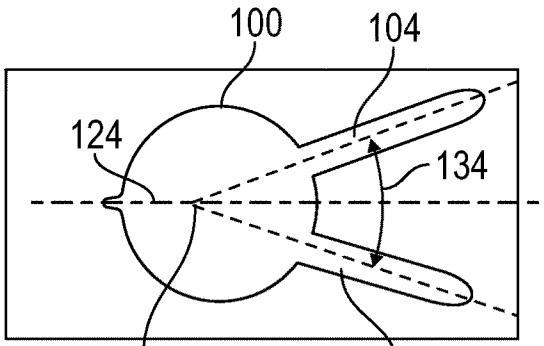
FIG. 9 depicts another arrangement of a dilution opening slotted portion, according to an embodiment of the present disclosure.

In the foregoing embodiments of the present disclosure, the slotted portion 104 was described as being a single slot extending downstream from the downstream edge of the main dilution hole portion 100. FIGS. 7 to 9 show some alternative embodiments of the slotted portion 104. In FIG. 7, the slotted portion 104 is seen to include a plurality of slots axially aligned along centerline axis 124. The plurality of slots may include a slotted portion 104, a second slot 130, and a third slot 132. A portion of the outer liner 54 provides a barrier between slotted portion 104 and second slot 130, and another portion of the outer liner 54 provides a barrier between second slot 130 and third slot 132. Third slot 132 may be tapered toward the downstream side.

In FIG. 8, another embodiment is seen to include two slotted portions 104, both extending downstream from a downstream edge of the main dilution hole portion 100. The two slotted portions 104 are seen to be disposed parallel to one another on either side of centerline axis 124, with a portion of the outer liner 54 forming a barrier between the slotted portions. Each of the slotted portions 104 in FIG. 8 may be similar to the slotted portion 104 of FIGS. 4 and 5, for example. Of course, the present disclosure is not limited to two slotted portions 104 and more than two could be implemented instead.

Referring to FIG. 9, another embodiment is seen to include two slotted portions 104 similar to those of FIG. 8, but rather than being parallel to one another, the slotted portions 104 may be arranged at an acute angle 134 with respect to the centerline axis 122 (see FIG. 5) of main dilution hole portion 100. The acute angle 134 may range from, for example, zero to ninety degrees. Of course, the present disclosure is not limited to the foregoing range and other angles may be implemented instead.

FIGS. 10 and 11 depicts various alternative embodiments of the slotted portion 104 from the plan view of the cold surface side of the outer liner 54. In FIG. 4, the slotted portion is depicted as being generally rectangular. In contrast, in FIG. 10, the slotted portion 104 is seen to be trapezoidal, with a narrower end of the trapezoid being at the downstream end of the slotted portion 104, and a wider portion of the trapezoid being at the downstream edge of the main dilution hole portion 100. In FIG. 11, the slotted portion 104 is seen to be a swoosh-type curve (e.g., a curved end), or curved slot with a converging end at the downstream end of the slotted portion.

Referring now to FIGS. 12 to 15, various embodiments of the main dilution hole portion are depicted. In FIGS. 4 and 5, the main dilution hole portion was depicted as a circular dilution hole. FIG. 12 depicts a teardrop-shaped main dilution hole portion 136. An upstream portion 144 of the main dilution hole portion 136 is generally shown as a semi-circle, while a downstream portion 146 of the main dilution hole portion 136 forms a teardrop shaped dilution hole. FIG. 13 depicts a dumbbell shaped main dilution hole portion that includes two generally overlapping oval shaped portions. For example, an oval-shaped upstream portion 138(*a*) and an oval-shaped downstream portion 138(*b*) may partially overlap and the oval-shaped upstream portion 138(*a*) may be larger than the oval-shaped downstream portion 138(*b*).

FIGS. 14 and 15 depict embodiments that include a truncated leading edge for the main dilution hole portion 100. In FIG. 14, a main dilution hole portion 140 is seen to be generally circular in shape, similar to the embodiment of FIG. 4. However, the upstream edge 103 of the circular hole has been truncated such that the main dilution hole portion 140 is generally a semi-circle. The straight leading edge of the semi-circle may include the notched portion 102 extending across the entire truncated leading edge. The notched portion 102 of this embodiment may include the slant angle 112 (see FIG. 5) and the slant angle may extend through the liner from the cold side surface to the hot side surface, or may only extend partially through the liner. FIG. 15 depicts an embodiment similar to that of FIG. 14, but with one difference being that the main dilution hole portion 142 is teardrop shaped as compared to the semi-circle of FIG. 14.

Figure 16:
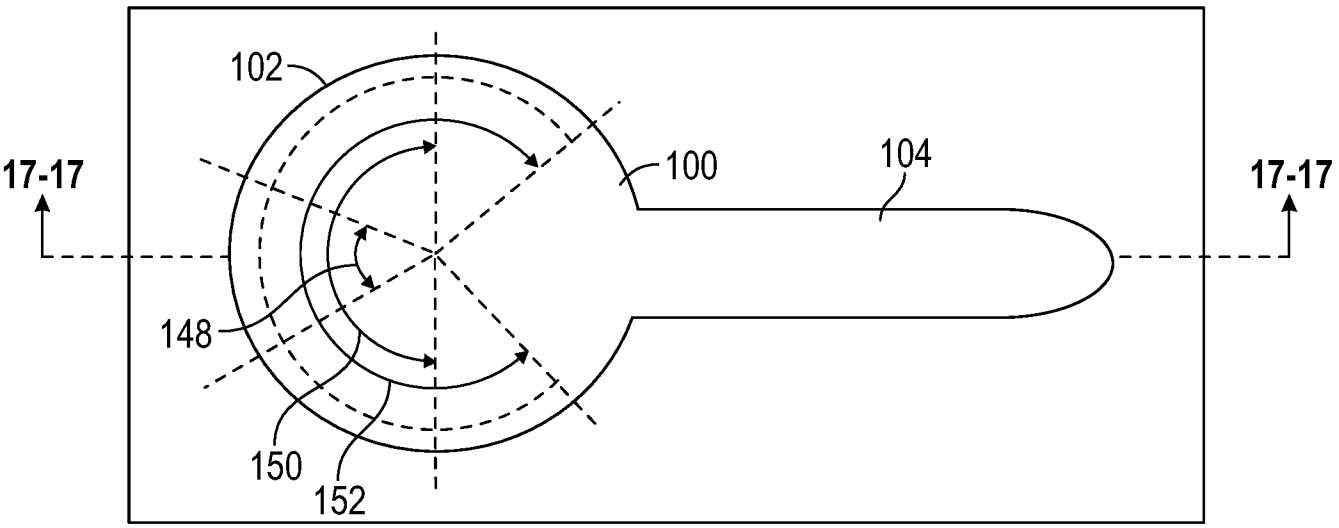
FIG. 16 depicts another arrangement of a dilution opening slotted portion, according to an embodiment of the present disclosure.
Figure 17:
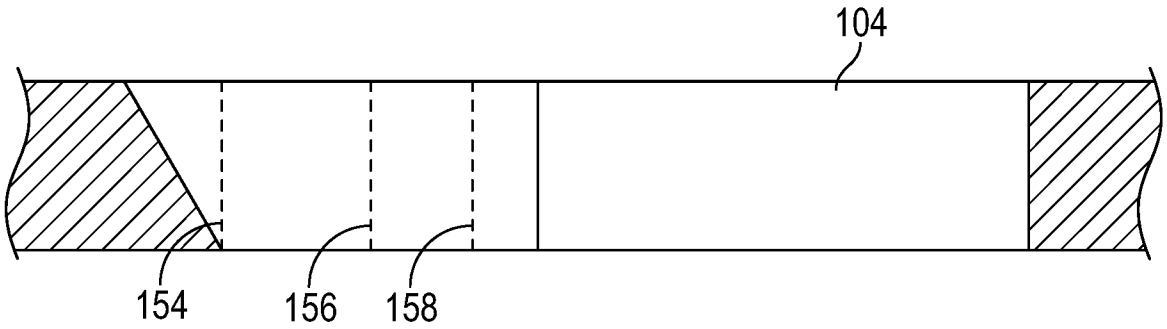
FIG. 17 depicts a partial cross-sectional view of the arrangement of the dilution opening slotted portion shown in FIG. 16, according to an embodiment of the present disclosure.

FIGS. 16 and 17 depict another embodiment of a dilution opening according to the present disclosure. In the foregoing examples, the notched portion 102 was depicted as, for example, a triangular shaped notch extending upstream of the circumferential surface of the main dilution hole portion 100. In FIGS. 16 and 17, by contrast, the notched portion 102 is shown integral with the circumferential surface of the main dilution hole portion 100. That is, the notched portion 102 can be seen to be formed as part of the main dilution hole portion 100 about the outer circumference. In various arrangements, the notched portion 102 may extend about the circumference in any of various angles, including thirty degrees (148) about the circumference, one-hundred-eighty degrees (150) about the circumference, or two-hundred-seventy degrees (152) about the circumference. FIG. 17 is a partial cross-sectional view of the dilution opening of FIG. 16 taken at plane 17-17. In FIG. 17, dashed line 154 represents the extent of the notched portion 102 at the thirty degree circumference 148, dashed line 156 represents the extent of the notched portion 102 at the one-hundred-eighty degree circumference 150, and dashed line 158 represents the extent of the notched portion 102 at the two-hundred-seventy degree circumference 152. The embodiments of FIGS. 16 and 17 may allow for the notched portion to provide even further adherence of the air flow to the leading edge surface of the main dilution hole, thereby reducing the flow separation even further.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A combustor for a gas turbine engine, the combustor comprising, a combustor liner having a cold surface side and a hot surface side, the combustor liner defining an upstream end and a downstream end and defining a combustion chamber on the hot surface side, a bypass oxidizer flow passage on the cold surface side of the combustor liner, the bypass oxidizer flow passage being defined between the cold surface side of the combustor liner and an outer casing of the combustor, the bypass oxidizer flow passage supplying a flow of oxidizer therethrough from the upstream end of the combustor liner to the downstream end of the combustor liner, and a dilution opening through the combustor liner, the dilution opening comprising, a main dilution hole portion having an upstream edge and a downstream edge, a notched portion disposed at the upstream edge and extending upstream from the upstream edge, the notched portion being in fluid communication with the main dilution hole portion, and a slotted portion disposed at the downstream edge and extending downstream of the downstream edge, the slotted portion being in fluid communication with the main dilution hole portion.

The combustor according to any preceding clause, wherein the main dilution hole portion is a circular portion and the notched portion defines a V-shaped notch with an apex thereof extending toward the upstream end.

The combustor according to any preceding clause, wherein the circular portion extends through the combustor liner from the cold surface side to the hot surface side, and wherein the notched portion extends partially through the combustor liner from the cold surface side.

The combustor according to any preceding clause, wherein the notched portion extends partially through the combustor liner at a slant angle from the apex at the cold surface side to a junction with the circular portion.

The combustor according to any preceding clause, wherein a first intersection of the notched portion and the main dilution hole portion defines a first fillet, and a second intersection of the notched portion and the main dilution hole portion defines a second fillet, and wherein a radius of the first fillet and a radius of the second fillet has a range from 2.5% to 20% of a diameter of the main dilution hole portion.

The combustor according to any preceding clause, wherein the acute angle has a range from five to sixty degrees with respect to a centerline axis of the circular portion.

The combustor according to any preceding clause, wherein a spread of the V-shaped notch has a range from fifteen to one hundred eighty degrees.

The combustor according to any preceding clause, wherein the main dilution hole portion is a circular portion, and wherein a width of the slotted portion has a range from 5% to 40% of a diameter of the main dilution hole portion.

The combustor according to any preceding clause, wherein the main dilution hole portion is circular, and wherein a length of the slotted portion has a range from 10% to 200% of a diameter of the main dilution hole portion.

The combustor according to any preceding clause, wherein the main dilution hole portion is circular, a first intersection of the slotted portion and the main dilution hole portion defines a first slot fillet, and a second intersection of the slotted portion and the main dilution hole portion defines a second slot fillet, and wherein a radius of the first slot fillet and a radius of the second slot fillet has a range from 2.5% to 20% of a diameter of the main dilution hole portion.

The combustor according to any preceding clause, wherein the main dilution hole portion comprises any one of, in a plan view from the cold surface side of the combustor liner, a teardrop shape, a dumbbell shape, and a semi-circular shape.

The combustor according to any preceding clause, wherein the slotted portion comprises any one of, in a plan view from the cold surface side of the combustor liner, a rectangular shape, a trapezoidal shape, or a curved shape.

The combustor according to any preceding clause, wherein the slotted portion, in a plan view of the cold surface side, is arranged at an acute angle with respect to a flow axis defined by the upstream end and the downstream end.

The combustor according to any preceding clause, wherein the slotted portion comprises a plurality of slots, a first slot of the plurality of slots nearest the main dilution hole portion is in fluid communication with the main dilution hole portion, and others of the plurality of slots are separated from the first slot.

The combustor according to any preceding clause, wherein the slotted portion comprises a plurality of slots each in fluid communication with the main dilution hole portion, and wherein the plurality of slots is arranged, in a plan view of the cold surface side of the combustor liner, in any one of parallel to one another extending downstream from the downstream edge, and arranged at an angle diverging from one another extending downstream from the downstream edge.

The combustor according to any preceding clause, wherein at least a portion of a sidewall of the slotted portion, in a downstream looking cross-sectional view, converges toward the hot surface side of the combustor liner.

The combustor according to any preceding clause, wherein the main dilution hole portion is circular, and the notched portion extends about a circumference of the main dilution hole portion from twenty to two hundred seventy degrees symmetrically with respect to an upstream/downstream centerline axis of the dilution opening.

The combustor according to any preceding clause, wherein the notched portion comprises any one of a circular shape or a triangular shape.

A combustor liner for a combustor of a gas turbine engine, the combustor liner comprising, a liner having a cold surface side and a hot surface side, the liner defining an upstream end and a downstream end, and a dilution opening through the combustor liner, the dilution opening comprising, a main dilution hole portion having an upstream edge and a downstream edge, a notched portion disposed at the upstream edge and extending upstream from the upstream edge, the notched portion being in fluid communication with the main dilution hole portion, and a slotted portion disposed at the downstream edge and extending downstream of the downstream edge, the slotted portion being in fluid communication with the main dilution hole portion.

The liner according to any preceding clause, wherein the main dilution hole portion is a circular portion and the notched portion defines a V-shaped notch with an apex thereof extending toward the upstream end.

The liner according to any preceding clause, wherein the circular portion extends through the combustor liner from the cold surface side to the hot surface side, and wherein the notched portion extends partially through the combustor liner from the cold surface side.

The liner according to any preceding clause, wherein the notched portion extends partially through the combustor liner at a slant angle from the apex at the cold surface side to a junction with the circular portion.

The liner according to any preceding clause, wherein a first intersection of the notched portion and the main dilution hole portion defines a first fillet, and a second intersection of the notched portion and the main dilution hole portion defines a second fillet, and wherein a radius of the first fillet and a radius of the second fillet has a range from 2.5% to 20% of a diameter of the main dilution hole portion.

The liner according to any preceding clause, wherein the acute angle has a range from five to sixty degrees with respect to a centerline axis of the circular portion.

The liner according to any preceding clause, wherein a spread of the V-shaped notch has a range from fifteen to one hundred eighty degrees.

The liner according to any preceding clause, wherein the main dilution hole portion is a circular portion, and wherein a width of the slotted portion has a range from 5% to 40% of a diameter of the main dilution hole portion.

The liner according to any preceding clause, wherein the main dilution hole portion is circular, and wherein a length of the slotted portion has a range from 10% to 200% of a diameter of the main dilution hole portion.

The liner according to any preceding clause, wherein the main dilution hole portion is circular, wherein a first intersection of the slotted portion and the main dilution hole portion defines a first slot fillet, and a second intersection of the slotted portion and the main dilution hole portion defines a second slot fillet, and wherein a radius of the first slot fillet and a radius of the second slot fillet has a range from 2.5% to 20% of a diameter of the main dilution hole portion.

The liner according to any preceding clause, wherein the main dilution hole portion comprises any one of, in a plan view from the cold surface side of the combustor liner, a teardrop shape, a dumbbell shape, and a semi-circular shape.

The liner according to any preceding clause, wherein the slotted portion comprises any one of, in a plan view from the cold surface side of the combustor liner, a rectangular shape, a trapezoidal shape, or a curved shape.

The liner according to any preceding clause, wherein the slotted portion, in a plan view of the cold surface side, is arranged at an acute angle with respect to a flow axis defined by the upstream end and the downstream end.

The liner according to any preceding clause, wherein the slotted portion comprises a plurality of slots, a first slot of the plurality of slots nearest the main dilution hole portion is in fluid communication with the main dilution hole portion, and wherein others of the plurality of slots are separated from the first slot.

The liner according to any preceding clause, wherein the slotted portion comprises a plurality of slots each in fluid communication with the main dilution hole portion, and wherein the plurality of slots is arranged, in a plan view of the cold surface side of the combustor liner, in any one of parallel to one another extending downstream from the downstream edge, and arranged at an angle diverging from one another extending downstream from the downstream edge.

The liner according to any preceding clause, wherein at least a portion of the slotted portion, in a downstream looking cross-sectional view, converges toward the hot surface side of the combustor liner.

The liner according to any preceding clause, wherein the main dilution hole portion is circular, and the notched portion extends about a circumference of the main dilution hole portion from twenty to two hundred seventy degrees symmetrically with respect to an upstream/downstream centerline axis of the dilution opening.

The liner according to any preceding clause, wherein the notched portion comprises any one of a circular shape or a triangular shape.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor for a gas turbine engine, the combustor comprising:

a combustor liner having a cold surface side and a hot surface side, the combustor liner defining an upstream end and a downstream end and defining a combustion chamber on the hot surface side;

a bypass oxidizer flow passage on the cold surface side of the combustor liner, the bypass oxidizer flow passage being defined between the cold surface side of the combustor liner and an outer casing of the combustor, the bypass oxidizer flow passage supplying a flow of oxidizer therethrough from the upstream end of the combustor liner to the downstream end of the combustor liner; and a dilution opening through the combustor liner, the dilution opening comprising:

a cylindrical main dilution hole portion having an upstream edge and a downstream edge, a centerline axis extending through a centerpoint of the cylindrical main dilution hole portion;

a notched portion disposed at the upstream edge and extending upstream from the upstream edge, the notched portion being in fluid communication with the main dilution hole portion, and the notched portion, in a plan view of the cold surface side of the combustor liner, defining a V-shaped notch with an apex thereof arranged upstream of the upstream edge and the apex being arranged on the centerline axis, a width of a base of the V-shaped notch, with respect to the centerline axis at an intersection of the base with the upstream edge on the cold surface side of the combustor liner being less than a diameter of the cylindrical main dilution hole portion; and a slotted portion disposed at the downstream edge and extending downstream of the downstream edge, the slotted portion being in fluid communication with the main dilution hole portion, and the slotted portion, in the plan view of the cold surface side of the combustor liner, defining a generally rectangular shape with a curved downstream end.

2. The combustor according to claim 1, wherein the cylindrical main dilution hole portion extends through the combustor liner from the cold surface side to the hot surface side, and wherein the notched portion extends partially through the combustor liner from the cold surface side.

3. The combustor according to claim 2, wherein the notched portion extends partially through the combustor liner at a slant angle from the apex at the cold surface side to a junction with the cylindrical main dilution hole portion.

4. The combustor according to claim 1, wherein a first intersection of the notched portion and the cylindrical main dilution hole portion defines a first fillet, and a second intersection of the notched portion and the cylindrical main dilution hole portion defines a second fillet, and wherein a radius of the first fillet and a radius of the second fillet has a range from 2.5% to 20% of a diameter of the cylindrical main dilution hole portion.

5. The combustor according to claim 3, wherein the slant angle is an acute angle having a range from five to sixty degrees with respect to a centerline axis of the cylindrical main dilution hole portion.

6. The combustor according to claim 1, wherein a spread angle of the V-shaped notch has a range from fifteen to ninety degrees.

7. The combustor according to claim 1, wherein a width of the slotted portion has a range from 5% to 40% of the diameter of the cylindrical main dilution hole portion.

8. The combustor according to claim 1, wherein a length of the slotted portion has a range from 10% to 200% of the diameter of the cylindrical main dilution hole portion.

9. The combustor according to claim 1, wherein a first intersection of the slotted portion and the cylindrical main dilution hole portion defines a first slot fillet, and a second intersection of the slotted portion and the cylindrical main dilution hole portion defines a second slot fillet, and wherein a radius of the first slot fillet and a radius of the second slot fillet has a range from 2.5% to 20% of the diameter of the cylindrical main dilution hole portion.

10. The combustor according to claim 1, wherein the slotted portion, in a plan view of the cold surface side, is arranged at an acute angle with respect to a flow axis defined by the upstream end and the downstream end.

11. The combustor according to claim 1, wherein the slotted portion comprises a plurality of slots, a first slot of the plurality of slots nearest the main dilution hole portion is in fluid communication with the main dilution hole portion, and others of the plurality of slots are separated from the first slot.

12. The combustor according to claim 1, wherein the slotted portion comprises a plurality of slots each in fluid communication with the main dilution hole portion, and wherein the plurality of slots is arranged, in a plan view of the cold surface side of the combustor liner, in any one of parallel to one another extending downstream from the downstream edge, and arranged at an angle diverging from one another extending downstream from the downstream edge.

13. The combustor according to claim 1, wherein at least a portion of a sidewall of the slotted portion, in a downstream looking cross-sectional view, converges toward the hot surface side of the combustor liner.

14. A combustor liner for a combustor of a gas turbine engine, the combustor liner comprising:

a liner having a cold surface side and a hot surface side, the liner defining an upstream end and a downstream end; and a dilution opening through the liner, the dilution opening comprising:

a cylindrical main dilution hole portion having an upstream edge and a downstream edge, a centerline axis extending through a centerpoint of the cylindrical main dilution hole portion;

a notched portion disposed at the upstream edge and extending upstream from the upstream edge, the notched portion being in fluid communication with the main dilution hole portion, wherein the notched portion defines, in a plan view of the cold surface side of the liner, a V-shaped notch with an apex thereof arranged upstream of the upstream edge and the apex being arranged on the centerline axis, a width of a base of the V-shaped notch, with respect to the centerline axis, at an intersection of the base with the upstream edge on the cold surface side of the liner being less than a diameter of the cylindrical main dilution hole portion; and a slotted portion disposed at the downstream edge and extending downstream of the downstream edge, the slotted portion being in fluid communication with the main dilution hole portion, and the slotted portion, in the plan view of the cold surface side of the liner, defining a generally rectangular shape with a curved downstream end.

* * * * *